US009131590B2

(12) United States Patent
Suzuki et al.

(10) Patent No.: US 9,131,590 B2
(45) Date of Patent: Sep. 8, 2015

(54) RADIATION GENERATING UNIT AND RADIOGRAPHY SYSTEM

(71) Applicant: CANON KABUSHIKI KAISHA, Tokyo (JP)

(72) Inventors: Yoshio Suzuki, Kawasaki (JP); Koichi Tsunoda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 143 days.

(21) Appl. No.: 14/043,275

(22) Filed: Oct. 1, 2013

(65) Prior Publication Data

US 2014/0093042 A1 Apr. 3, 2014

(30) Foreign Application Priority Data

Oct. 2, 2012 (JP) ..... 2012-219989

(51) Int. Cl.
*H01J 35/12* (2006.01)
*H05G 1/02* (2006.01)
*H05G 1/06* (2006.01)

(52) U.S. Cl.
CPC . *H05G 1/025* (2013.01); *H05G 1/06* (2013.01)

(58) Field of Classification Search
CPC . H01J 35/105; H01J 35/12; H01J 2235/1262; H01J 2235/1283
USPC ..... 378/141, 199, 200
See application file for complete search history.

(56) References Cited

FOREIGN PATENT DOCUMENTS

| | | | |
|---|---|---|---|
| JP | 2004-022459 | A | 1/2004 |
| JP | 2007-149521 | A | 6/2007 |
| JP | 2012-028093 | A | 2/2012 |

*Primary Examiner* — Jurie Yun
(74) *Attorney, Agent, or Firm* — Canon USA Inc. IP Division

(57) ABSTRACT

A radiation generating unit includes a radiation tube that has a vacuum chamber that has a cathode and anode at both ends of an insulating tubular member and is arranged inside a storage container filled with an insulating liquid in a state in which the radiation tube is arranged inside an insulating outer casing tube with a gap from a surrounding, wherein walls which partition the gap between the radiation tube and outer casing tube are provided while allowing a flow of the insulating liquid between the cathode side and anode side of the radiation tube and leaving in the gap a flow path which does not linearly continue to the cathode side and anode side.

17 Claims, 7 Drawing Sheets

RADIATION GENERATING UNIT AND RADIOGRAPHY SYSTEM

BACKGROUND

1. Field

Aspects of the present invention generally relates to a radiation generating unit which is used for such as non-destructive X-ray photography in a medical device field and an industrial device field, and a radiography system which uses the radiation generating unit.

2. Description of the Related Art

Generally, by applying a high voltage between a cathode and an anode installed in a radiation tube, a radiation generating unit irradiates an anode with electrons discharged from the cathode and produces radiation rays such as X rays. Such a radiation generating unit adopts a structure in which a radiation tube and a driving unit are accommodated in a container filled with an insulating liquid to cool the radiation tube and to secure the dielectric strength against a high voltage.

When electrons discharged from a cathode are incident on an anode, efficiency to generate radiation rays is poor, and therefore almost all incident energy is converted into heat in the radiation generating unit. The heat generated in the anode is conducted to a radiation tube wall, transmits to the insulating liquid and is finally released to an external atmosphere through a storage container from the insulating liquid.

However, a flow of the insulating liquid in a wide range and effective transfer of heat of a high temperature portion to a low temperature portion are important to sufficiently cool the vicinity of an anode and release heat generated at the anode to an outside through the storage container.

Further, high voltages of about 70 to 150 kV are applied to both poles of a radiation tube. Hence, even when a container is filled with an insulating liquid, creeping discharge occurs at a surrounding portion of the radiation tube in some rare cases, and, when reaching a driving unit, this discharged electricity damages circuits.

Japanese Patent Application Laid-Open No. 2012-28093 discloses an X-ray generating device in which an X-ray tube is arranged in an insulating outer casing tube provided with multiple holes and with a gap in the surrounding such that insulating oil can freely flow. The insulating oil has a function of preventing discharge of electricity and cooling the X-ray tube.

As described above, although, since a radiation tube is covered by an insulating material in a conventional radiation generating unit, an effect of preventing creeping discharge to a circuit substrate can be expected, an effect of preventing micro creeping discharge of electricity generated near a surface of the radiation tube and in an electric field direction between a cathode and an anode is not provided. Therefore, development of tracking of a radiation tube causes damage on the radiation tube.

SUMMARY

Aspects of the present invention generally related to enabling both suppression of creeping discharge and cooling of a radiation tube via a structure of an insulating container that surrounds the radiation tube in a radiation generating unit.

According to an aspect of the present invention, a radiation generating unit includes a radiation tube configured to include a vacuum chamber having a cathode and an anode at both ends of an insulating tubular member, an insulating outer casing tube in which the radiation tube is arranged with a gap from a surrounding, and a driving unit configured to control an operation of the radiation tube, wherein the radiation tube, the insulating outer casing tube, and the driving unit are arranged inside a storage container, and wherein an extra space inside the storage container is filled with an insulating liquid and wherein a wall configured to partition the gap allows a flow of the insulating liquid between a cathode side and an anode side of the vacuum chamber and forms a flow path configured not to linearly continue to the cathode side and the anode side of the vacuum chamber.

Further features of the present disclosure will become apparent from the following description of exemplary embodiments (with reference to the attached drawings).

DESCRIPTION OF THE EMBODIMENTS

Hereinafter, exemplary embodiments will be described using the drawings. In addition, although a transmissive radiation tube is described, a reflective radiation tube can also be used.

First Embodiment

Figure 1:
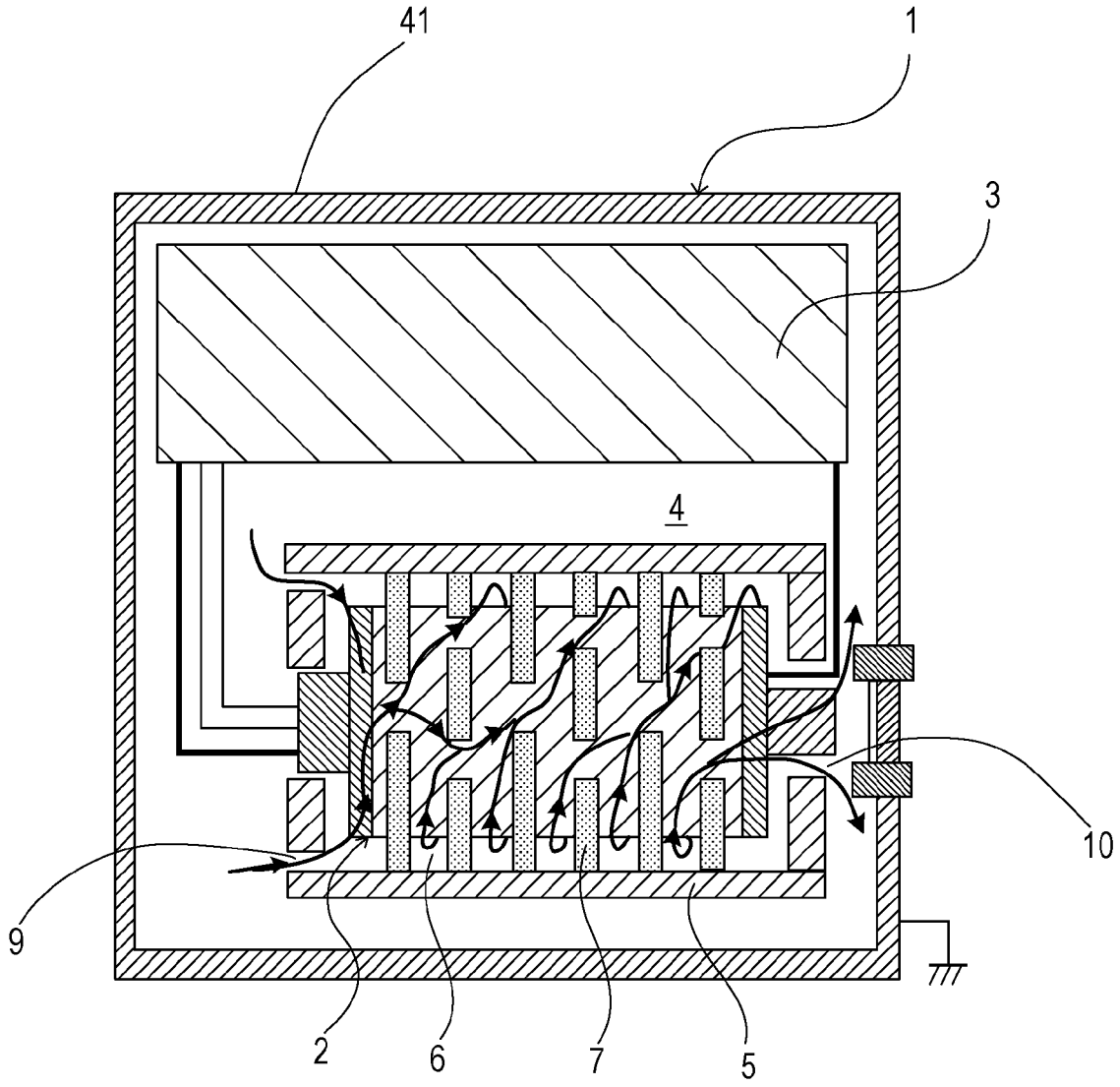
FIG. 1 is a cross-sectional schematic view illustrating an exemplary embodiment of a radiation generating unit.

FIG. 1 is a cross-sectional schematic view of a radiation generating unit.

A radiation generating unit 1 has a storage container 41, an insulating outer casing tube 5 which is arranged inside the storage container 41, a radiation tube 2 which is arranged inside the outer casing tube 5 and with a gap from a surrounding and a driving unit 3 which is arranged inside the storage container 41 and outside the outer casing tube 5. An extra space inside the storage container 41 is filled with an insulating liquid 4 which is an insulating medium for securing the creeping dielectric strength of the radiation tube 2 and which is a cooling medium. The driving unit 3 controls an operation of the radiation tube 2.

Figure 2:
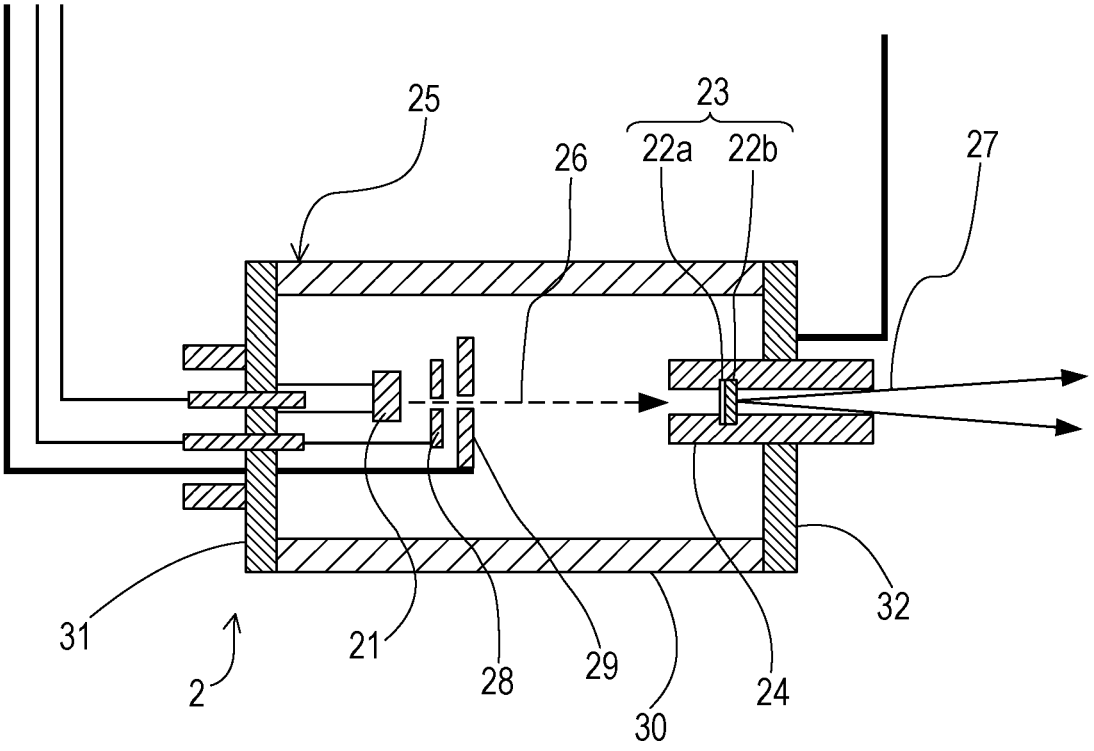
FIG. 2 is a schematic cross-sectional view illustrating an exemplary embodiment of a basic structure of a radiation tube.

As illustrated in FIG. 2, the radiation tube 2 has a vacuum chamber 25 which has a cathode 31 and an anode 32 at both ends of an insulating tubular member 30. In the vacuum chamber 25, an electron source 21 is provided, and, at an intermediate portion of a penetrating hole of a tubular shielding member 24 bonded to an opening portion of the anode 32, a target 23 is provided opposing to the electron source 21. The target 23 is formed with a support substrate 22*b*, and a target layer 22*a* provided on a surface of the support substrate 22*b* which opposes to the electron source 21. The target layer 22*a* generates a radiation ray when irradiated with an electron discharged from the electron source 21.

The tubular member 30 has a cylindrical shape, and is made of, for example, glass or a ceramic material. The degree of vacuum in the vacuum chamber 25 only needs to be about $1\times10^{-4}$ to $1\times10^{-8}$Pa. The shielding member 24 has a channel which continues to the opening portion of the vacuum chamber 25, and, when the support substrate 22*b* is bonded to this channel to block the channel, the vacuum chamber 25 is sealed. Further, a transmissive radiation tube is used in the present embodiment, and the target 23 itself plays a role of an emission window which emits radiation rays. When a reflective radiation tube is used, an emission window which allows transmission of radiation rays while sealing the vacuum chamber 25 is provided in addition to the target 23.

For the electron source 21, a hot cathode such as a tungsten filament or an impregnated cathode or a cold cathode such as a carbon nanotube can be used.

A constituent material of the target layer 22*a* is preferably a high atomic number material such as tungsten, tantalum or molybdenum which more easily generates radiation rays. A constituent material of the support substrate 22*b* is preferably a low atomic number material such as beryllium or diamond which has a high strength and radiation transmissivity.

The driving unit 3 is connected with the electron source 21, a lead electrode 28 and a lens electrode 29, and provides a predetermined voltage. Further, the driving unit 3 applies an acceleration voltage of 40 to 150 kV which is applied between both poles (the cathode 31 and the anode 32) of the radiation tube 2, and which accelerates electrons.

For the insulating liquid 4, electric insulating oil is preferably used and, more specifically, silicone oil, transformer oil or fluorine oil can be suitably used.

The outer casing tube 5 protects the driving unit 3 from electricity discharged from the radiation tube 2. Although the outer casing tube 5 has a cylindrical shape, the outer casing tube 5 may have a shape such as a box as long as a flow path which allows a flow of the insulating liquid 4 is secured. Further, a plurality of holes may be provided to the outer casing tube 5 to prevent creeping discharge to an outside and allow the insulating liquid 4 to easily flow. In this case, by diagonally forming holes in a thickness direction of the outer casing tube 5, it is possible to decrease occurrence of creeping discharge to an outside of the outer casing tube 5.

Figure 3A:
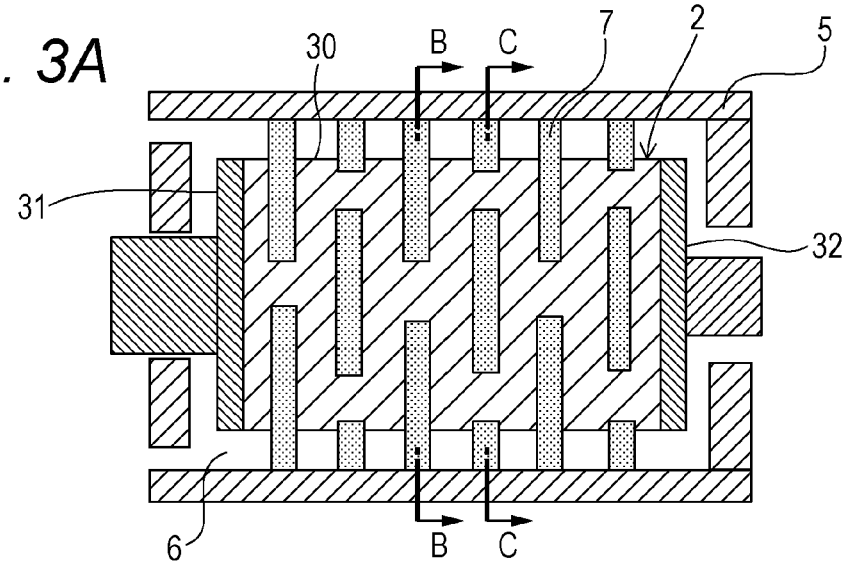
FIGS. 3A to 3C are schematic views illustrating an arrangement of walls according to a first embodiment, and 3A is a cross-sectional schematic view, 3B is a B-B cross-sectional view in 3A and 3C is a C-C cross-sectional view in 3A.
Figure 3B:
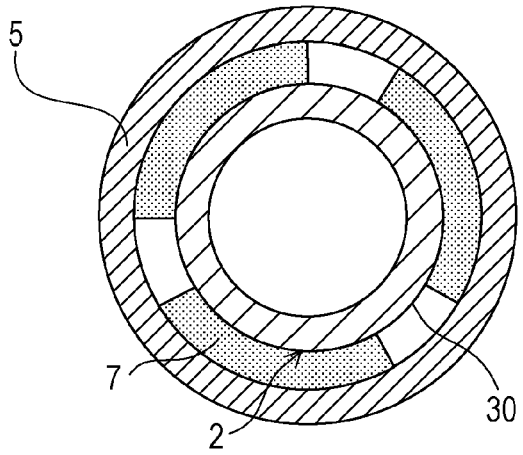
Figure 3C:
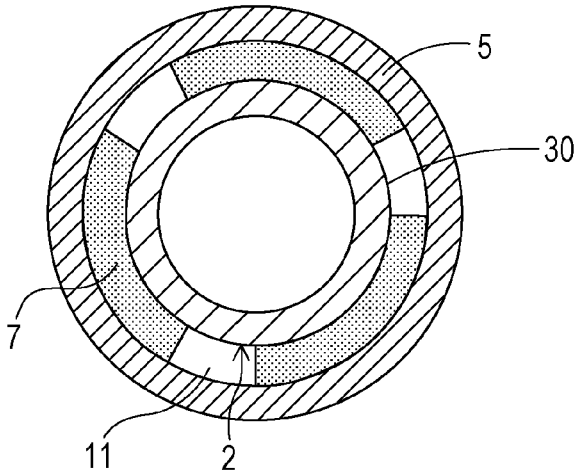

As illustrated in FIG. 3, inside the outer casing tube 5, the radiation tube 2 is arranged by providing in a surrounding a gap 6 which allows the insulating liquid 4 to flow. The outer casing tube 5 and the tubular member 30 have cylindrical shapes and center axes which substantially match. A plurality of (three in the present embodiment) walls 7 which has a height reaching an inner surface of the outer casing tube 5 from an outer surface of the tubular member 30 is arranged at predetermined intervals in a circumferential direction of the tubular member 30. Further, a plurality of (six columns in the present embodiment) columns of the walls 7 is arranged at predetermined intervals in an axial direction of the tubular member 30.

An interval between the walls 7 in one column and the interval between the columns form a flow path which allows a flow of the insulating liquid 4 (in the axial direction) between the cathode side and the anode side of the vacuum chamber. Further, intervals between the walls 7 in neighboring columns are completely shifted without overlapping in the axial direction, so that the walls 7 form flow paths which do not linearly continue to the cathode side and the anode side of the vacuum chamber (in the axial direction). Meanwhile, to form linearly non-continuous flow paths, intervals of the walls 7 in one of columns of a plurality of the walls 7 only need to be arranged without overlapping the intervals of the walls 7 in at least one of the other columns in the axial direction.

The walls 7 suppress creeping discharge while preventing linear discharge between the cathode 31 and the anode 32. The wall 7 is made of an insulating material of a flat shape made of an acrylic resin or an epoxy resin. Although the walls 7 in the present embodiment have fan shapes since the outer casing tube 5 and the radiation tube 2 have cylindrical shapes, the shapes of the walls 7 can be adequately selected according to the shapes of the outer casing tube 5 and the radiation tube 2.

As illustrated in FIG. 1, the insulating liquid 4 flows in the outer casing tube 5 from a flow path inlet 9 as indicated by an arrow, freely flows toward a flow path outlet 10 through the gap 6 between the radiation tube 2 and the outer casing tube 5, and cools the radiation tube 2. Although the insulating liquid 4 can be forced to flow by a liquid supply device which is not illustrated, it is possible to cause a spontaneous flow according to an electrohydrodynamic effect in a state in which an acceleration voltage is applied. The insulating liquid 4 releases heat discharged to an outside of the outer casing tube 5 and absorbed from the radiation tube 2.

Simply providing the outer casing tube 5 can prevent expansion of a discharge damage on the surrounding, and cannot decrease an occurrence rate of micro creeping discharge which occurs between the cathode 31 and the anode 32. When even micro creeping discharge is repeated, discharge decomposition of the insulating liquid 4 proceeds, thereby deteriorating the insulating liquid 4. Further, tracking occurs on the surface of the radiation tube 2 in some cases, which accelerates long-term deterioration of a dielectric strength of the entire radiation generating unit 1.

The present embodiment employs a configuration having a plurality of walls 7 between the outer casing tube 5 and the tubular member 30, so that it is possible to divide an electric field between both poles and, consequently, suppress micro discharge which occurs on the surface of the radiation tube 2.

Further, the walls 7 which are aligned to surround the radiation tube 2 and which have intervals arranged not to linearly continue in the axial direction are provided, so that it is possible to secure a flow of the insulating liquid 4 without undermining an effect of suppressing creeping discharge. Furthermore, positions of the intervals between the walls 7 are shifted, so that the insulating liquid 4 uniformly flows on the surface of the radiation tube 2 and effectively cool the entire radiation tube 2.

Second Embodiment

Figure 4A:
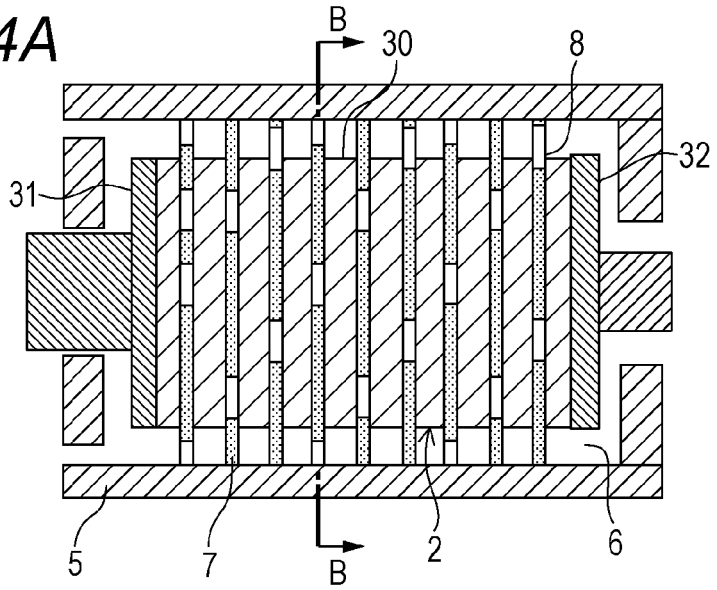
FIG. 4A to 4C are schematic views illustrating an arrangement of walls according to a second embodiment, and 4A is a cross-sectional schematic view, 4B is a B-B cross-sectional view in 4A and 4C is a view illustrating an example of positions at which cutout portions are provided.
Figure 4C:
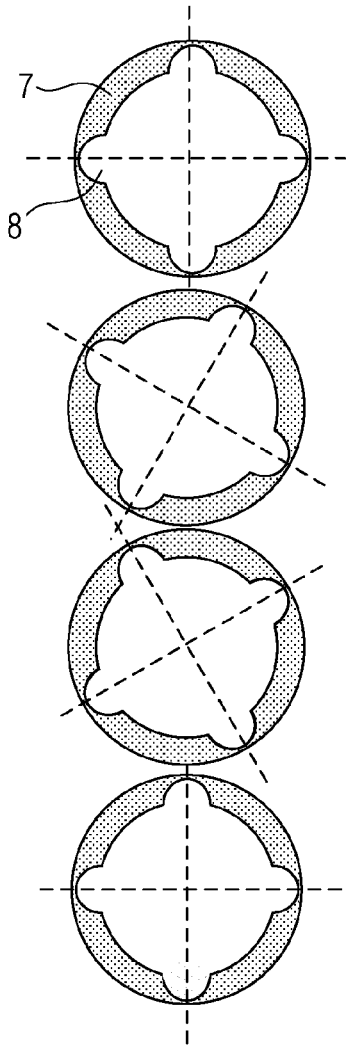
Figure 4B:
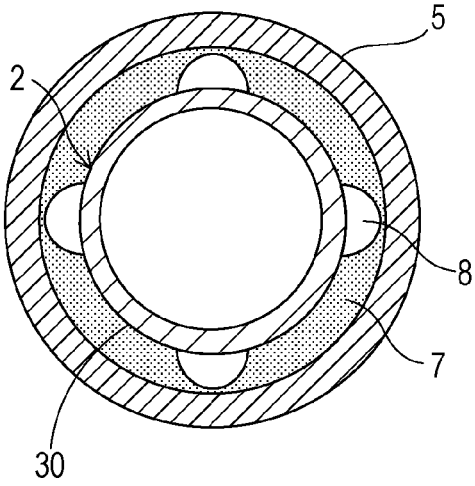

As illustrated in FIG. 4, the wall 7 according to the present embodiment has a height reaching the inner surface of an outer casing tube 5 from an outer surface of the tubular member 30 and a partial cutout portion 8, and has an annular shape provided in a circumferential direction of the tubular member 30. Further, a plurality of the walls 7 is provided at intervals in the axial direction.

The cutout portions 8 provided to each wall 7 and intervals between the walls 7 provided in the axial direction form a flow path which allows a flow of the insulating liquid 4. Further, positions of the cutout portions 8 of the neighboring walls 7 are completely shifted without overlapping to form a flow path which does not linearly continue in the axial direction. Meanwhile, to form a linearly non-continuous flow path, the cutout portions 8 of the walls 7 in one column of a plurality of the walls 7 only need to be arranged without overlapping the cutout portions 8 of at least one of the other walls 7. In addition, FIG. 4C illustrates the walls 7 on a B-B line in FIG. 4A, and positions of the cutout portions 8 of the four walls 7 in total including this wall 7 to the third wall on the anode 32 side.

The cutout portion 8 has an almost semi-circular shape, and is provided on a contact side of the wall 7 with respect to the tubular member 30. Although the cutout portion 8 can be provided on an outer periphery side of the wall 7 which is the contact side with respect to the outer casing tube 5, the insulating liquid 4 which can easily cool the radiation tube 2 easily flows, and therefore the cutout portion 8 is preferably provided on the contact side of the wall 7 with respect to the tubular member 30.

According to the present embodiment, the walls 7 are not divided in a circumferential direction, so that it is possible to reduce the number of the walls 7 compared to the first embodiment.

Third Embodiment

Figure 5A:
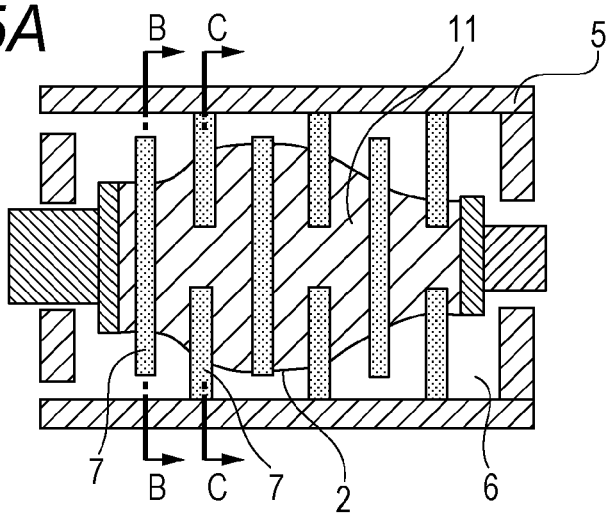
FIG. 5A to 5C are schematic views illustrating a shape of a radiation tube according to a third embodiment, and 5A is a cross-sectional schematic view, 5B is a B-B cross-sectional view in 5A and 5C is a C-C cross-sectional view in 5A.
Figure 5B:
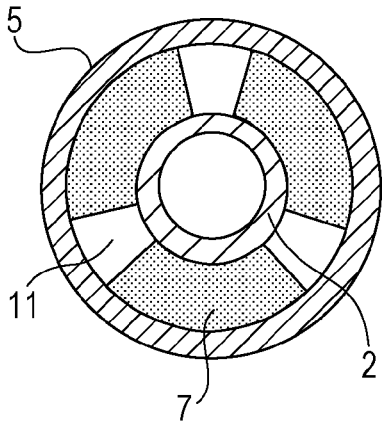
Figure 5C:
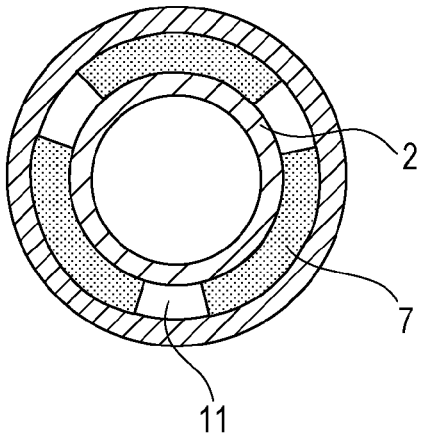

As illustrated in FIG. 5, the radiation tube 2 according to the present embodiment has a vase shape having a larger outer diameter of a center portion of the tubular member 30 than both end portions. Similar to the first embodiment, the wall 7 has a height reaching an inner surface of the outer casing tube 5 from an outer surface of the tubular member 30, and a plurality of the walls 7 is aligned at intervals in a circumferential direction of the tubular member 30. However, the diameter of the tubular member 30 is not fixed, and, as illustrated in FIGS. 5B and 5C, the height of the wall 7 on the center portion side is lower than that of the wall 7 on an end portion side of the tubular member 30.

According to the present embodiment, a length along the outer surface of the tubular member 30 in the axial direction is long compared to the first embodiment, so that creeping discharge between the cathode 31 and the anode 32 is more easily suppressed. Further, the walls 7 according to the second embodiment or a fourth embodiment described below can also be used.

Fourth Embodiment

Figure 6:
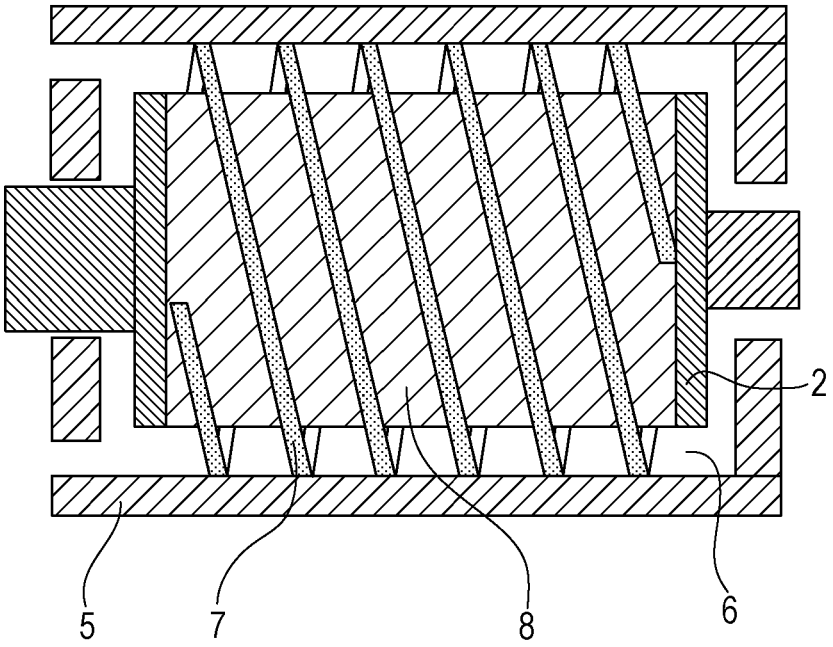
FIG. 6 is a schematic view illustrating an arrangement of a wall according to a fourth embodiment.

As illustrated in FIG. 6, the wall 7 according to the present embodiment has a height reaching an inner surface of the outer casing tube 5 from an outer surface of the tubular member 30, and is spirally provided in a circumferential direction of the tubular member 30. An interval formed between the spirally arranged wall 7 forms a flow path which allows a flow of the insulating liquid 4 in an axial direction. Further, the wall 7 is spirally provided, and forms a flow path which does not linearly continue in the axial direction.

According to the present embodiment, the wall 7 is not divided, so that the number of members is one.

Fifth Embodiment

Figure 7:
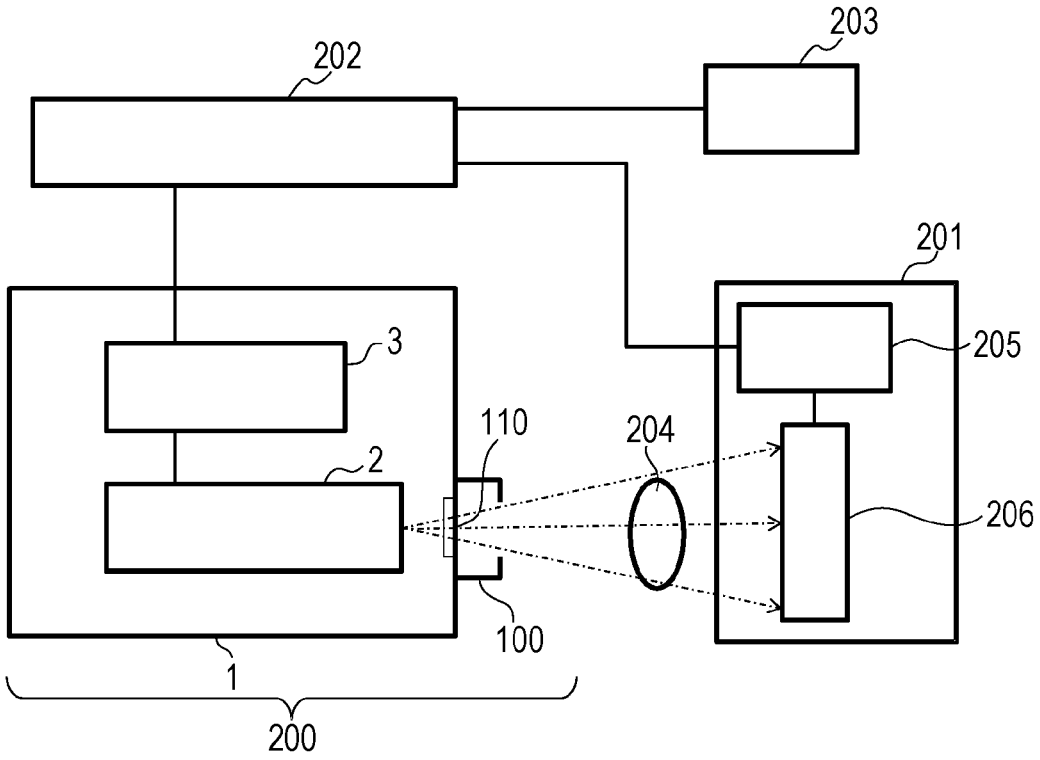
FIG. 7 is a block diagram illustrating an exemplary embodiment of a radiography system.

An example of a radiography system according to the present embodiment will be described based on FIG. 7.

The radiation generating unit 1 described in the first to fourth embodiments, and a movable diaphragm unit 100 provided to an emission window 110 portion form a radiation generating device 200. The movable diaphragm unit 100 has a function of adjusting a range of a radiation field of radiation rays irradiated from the radiation generating unit 1. Further, the movable diaphragm unit 100 to which a function of providing mock-up of a radiation field of radiation rays by means of visible light is added can also be used.

A system control device 202 controls the radiation generating device 200 and a radiation detecting device 201 in combination. The driving unit 3 outputs various control signals to the radiation tube 2 under control of the system control device 202. According to this control signal, a release state of radiation rays released from the radiation generating device 200 is controlled. The radiation ray released from the radiation generating device 200 transmits through a test object 204 and is detected by a detector 206. The detector 206 converts the detected radiation ray into an image signal, and outputs the image signal to a signal processing unit 205. The signal processing unit 205 performs predetermined signal processing on the image signal under control of the system control device 202, and outputs the processed image signal to the system control device 202. The system control device 202 outputs a display signal for causing a display device 203 to display an image, to the display device 203 based on the processed image signal. The display device 203 displays the image based on the display signal, on a screen as a captured image of the test object 204. A typical example of a radiation ray is an X ray, and the radiation generating unit 1 and the radiography system according to the present embodiment can be used as an X-ray generating unit and an X-ray photography system. The X-ray photography system can be used for non-destructive inspection of industrial products and for pathological diagnosis of human bodies and animals.

EXAMPLES

Example 1

Example 1 will be described using FIG. 3.

The dimensions of main parts of a radiation tube 2 include 45 mm of a tube diameter and 80 mm of a tube length, and an insulating portion is made using alumina ceramics, an external electrode on a cathode side is made using stainless steel and an external electrode on an anode side is made using stainless steel and copper as main materials.

The dimensions of the main parts of an outer casing tube 5 include 60 mm of the inner diameter, 100 mm of an outer casing tube length, and the outer casing tube 5 is made of an acrylic resin having 5 mm of the thickness.

The wall 7 provided between an outer surface of the radiation tube 2 and an inner wall of the outer casing tube 5 is formed using an acrylic resin having the thickness of 5 mm, the dimensions of the main parts include 7.5 mm of height, and the three walls 7 are arranged at about 60 mm of intervals to form a gap 11 in each outer periphery column in a coaxial circumferential direction of the radiation tube 2. Six columns are arranged at 7.5 mm of intervals in a length direction of the radiation tube, and are arranged by being each shifted 60 degrees in the circumferential direction such that the gaps 11 do not overlap between neighboring columns.

Example 2

Example 2 will be described using FIG. 4.

Dimensions of main parts of the radiation tube 2 are the same as those in Example 1, and include 45 mm of a tube diameter and 80 mm of a tube length. An insulating portion is made using alumina ceramics, an external electrode on a cathode side is made using stainless steel and an external electrode on an anode side is made using stainless steel and copper as main materials.

The dimensions of the outer casing tube 5 are the same as those in Example 1, the dimensions of the main part include 60 mm of the inner diameter, 100 mm of an outer casing tube length and the outer casing tube is made of an epoxy resin having 5 mm of the thickness.

In present Example, a wall provided between an outer surface of the radiation tube 2 and an inner wall of the outer casing tube 5 is the wall 7 which is an annular body formed using an epoxy resin having 2 mm of the thickness. This wall 7 adopts a structure in which four cutout portions 8 are provided at equal intervals.

The wall 7 has 7.5 mm of the height, and the nine walls 7 are arranged at 5 mm of intervals in a length direction of a radiation tube. The walls 7 which are neighboring in the longitudinal direction of the radiation tube are arranged by being each rotated at 30 degrees in a circumferential direction so that the cutout portions 8 do not overlap at the same positions.

Example 3

Example 3 will be described using FIG. 5.

Both poles of a radiation tube 2 have different tube diameters in a direction in which both poles oppose. Accordingly, structures of the walls 7 have different heights depending on positions at which both poles of the walls 7A and 7B are installed.

The tube diameter is 45 mm of a maximum diameter and is 30 mm of a minimum diameter, and a tube length is 80 mm.

An insulating portion is made using a glass material, an external electrode on a cathode side is made using stainless steel and an external electrode on an anode side is made using stainless steel and copper as main materials.

The dimensions of the main parts of the outer casing tube 5 include 60 mm of the inner diameter, 100 mm of an outer casing tube length, and the outer casing is made of an epoxy resin having 5 mm of the thickness.

The wall 7 provided between a surface of the radiation tube 2 and an inner wall of the outer casing tube 5 is formed using an epoxy resin having 5 mm of the thickness, and the height thereof is adjusted according to a position at which the wall 7 is installed as illustrated in FIG. 5.

Similar to Example 1, the three walls 7 are arranged at about 10 mm of intervals to form the gap 11 in each outer peripheral column in the coaxial circumferential direction of the radiation tube 2 and secure a flow path. Six columns are arranged at 7.5 mm of intervals in a longitudinal direction of the radiation tube, and are arranged by being each shifted 60 degrees in the circumferential direction such that the gaps 11 do not overlap between the neighboring columns.

Example 4

Example 4 will be described using FIG. 6.

The dimensions of main parts of the radiation tube 2 are the same as those in Example 1.

A tube diameter is 45 mm and a tube length is 80 mm, and an insulating portion is made using alumina ceramics, an external electrode on a cathode side is made using stainless steel and an external electrode on an anode side is made using stainless steel and copper as main materials.

The dimensions of the main parts of the outer casing tube 5 include 60 mm of the inner diameter, 100 mm of an outer casing tube length, and the outer casing tube is made of an acrylic resin having 5 mm of the thickness.

A wall 7 provided between an outer surface of the radiation tube 2 and an inner wall of the outer casing tube 5 adopts a structure obtained by spirally molding epoxy resins having 2 mm of the thickness and 7.5 mm of the height and providing about 10 mm of intervals between columns, in the inner wall of the radiation tube 2.

Even this configuration can secure the walls in an electric field direction and a flow path of the insulating liquid.

Although the radiation tube 2 described in each of the above Examples is attached to a radiation generating unit 1 and an acceleration voltage of 100 kV is applied, discharged electricity is not detected from an outside.

Further, when high voltage insulating oil is used as the insulating liquid 4, a flow is caused along the surface of the radiation tube by an electrohydrodynamic effect and insulating oil circulates inside and outside the outer casing tube 5, so that it is possible to perform effective cooling.

The present embodiment adopts a structure in which an outer side of a radiation tube is covered by an insulating outer casing tube and, consequently, can prevent discharged electricity generated near the radiation tube from damaging a substrate such as a driving circuit in the surrounding.

A flow path which allows a flow of an insulating liquid is provided between a cathode side and an anode side of a vacuum chamber, so that the insulating liquid can flow on the surface of the radiation tube and the insulating liquid can circulate inside and outside the outer casing tube. Consequently, it is possible to efficiently cool the radiation tube and perform continuous irradiation of radiation rays at a high output for a long period of time.

Further, the flow path does not linearly continue to the cathode side and the anode side of the vacuum chamber, so that it is possible to effectively suppress occurrence of creeping discharge through the flow path and suppress deterioration of an insulating liquid and development of tracking of the radiation tube.

While the present disclosure has been described with reference to exemplary embodiments, these embodiments are not seen to be limiting. The scope of the following claims is to be accorded the broadest interpretation so as to encompass all such modifications and equivalent structures and functions.

This application claims the benefit of Japanese Patent Application No. 2012-219989, filed Oct. 2, 2012, which is hereby incorporated by reference herein in its entirety.

What is claimed is:

1. A radiation generating unit comprising:

a radiation tube configured to include a vacuum chamber having a cathode and an anode at both ends of an insulating tubular member;

an insulating outer casing tube in which the radiation tube is arranged with a gap from a surrounding; and a driving unit configured to control an operation of the radiation tube, wherein the radiation tube, the insulating outer casing tube, and the driving unit are arranged inside a storage container, and wherein an extra space inside the storage container is filled with an insulating liquid, and wherein a wall configured to partition the gap allows a flow of the insulating liquid between a cathode side and an anode side of the vacuum chamber and forms a flow path configured not to linearly continue to the cathode side and the anode side of the vacuum chamber.

2. The radiation generating unit according to claim 1, wherein the wall has a height reaching an inner surface of the outer casing tube from an outer surface of the tubular member, and wherein a plurality of the walls is aligned at intervals in a circumferential direction of the tubular member, and wherein a plurality of columns that are aligned in the circumferential direction of the tubular member is provided at intervals in an opposing direction of the cathode and the anode, and wherein an interval between the walls in one of the columns of the plurality of the walls is shifted from a position of an interval between the walls in at least one of other columns.

3. The radiation generating unit according to claim 2, wherein the interval between the walls in one of the columns of the plurality of walls is arranged by being completely shifted from the interval between the walls in at least one of other columns not to overlap in the opposing direction of the cathode and the anode.

4. The radiation generating unit according to claim 2, wherein positions of intervals between the walls in neighboring columns are shifted.

5. The radiation generating unit according to claim 1, wherein the wall has a height reaching an inner surface of the outer casing tube from an outer surface of the tubular member, a partial cutout portion, and forms an annular shape provided in a circumferential direction of the tubular member, and wherein a plurality of the walls is provided at intervals in an opposing direction of the cathode and the anode, and wherein a position of the cutout portion of one of the plurality of walls is shifted from at least a cutout portion of one of other walls.

6. The radiation generating unit according to claim 5, wherein positions of the cutout portions of the neighboring walls are shifted.

7. The radiation generating unit according to claim 5, wherein the cutout portion is provided on a contact side of the wall with respect to the tubular member.

8. The radiation generating unit according to claim 1, wherein the wall has a height reaching an inner surface of the outer casing tube from an outer surface of the tubular member, and is spirally provided in a circumferential direction of the tubular member.

9. The radiation generating unit according to claim 1, wherein an outer diameter of a center portion of the tubular member is larger than both end portions.

10. The radiation generating unit according to claim 1, wherein the wall has a flat shape.

11. The radiation generating unit according to claim 1, wherein the wall is made of an acrylic resin or an epoxy resin.

12. The radiation generating unit according to claim 1, wherein the outer casing tube is made of an acrylic resin or an epoxy resin.

13. The radiation generating unit according to claim 1, wherein a plurality of holes is formed in the outer casing tube.

14. The radiation generating unit according to claim 13, wherein the holes are diagonally formed with respect to a thickness direction of the outer casing tube.

15. The radiation generating unit according to claim 1, wherein the insulating liquid is silicone oil, transformer oil or fluorine oil.

16. The radiation generating unit according to claim 1, wherein the radiation tube is a transmissive radiation tube.

17. A radiography system comprising:

a radiation generating unit configured to include:

a radiation tube configured to include a vacuum chamber having a cathode and an anode at both ends of an insulating tubular member;

an insulating outer casing tube in which the radiation tube is arranged with a gap from a surrounding; and a driving unit configured to control an operation of the radiation tube, wherein the radiation tube, the insulating outer casing tube, and the driving unit are arranged inside a storage container, and wherein an extra space inside the storage container is filled with an insulating liquid, and wherein a wall configured to partition the gap allowing a flow of the insulating liquid between a cathode side and an anode side of the vacuum chamber and forming a flow path configured not to linearly continue to the cathode side and the anode side of the vacuum chamber;

a radiation detecting device configured to detect a radiation ray discharged from the radiation generating unit and transmitting through a test object; and a control device configured to control the radiation generating unit and the radiation detecting device in combination.

* * * * *